US006231484B1

(12) United States Patent
Gordon

(10) Patent No.: US 6,231,484 B1
(45) Date of Patent: May 15, 2001

(54) SKI SIMULATING EXERCISE MACHINE

(76) Inventor: Trace O. Gordon, 3880 W. Lariat Rd., Park City, UT (US) 84098

( * ) Notice: Subject to any disclaimer, the term of this patent is extended or adjusted under 35 U.S.C. 154(b) by 0 days.

(21) Appl. No.: 09/019,416

(22) Filed: Feb. 5, 1998

(51) Int. Cl.[7] ..... A63B 69/18
(52) U.S. Cl. ..... 482/71; 482/51
(58) Field of Search ..... 482/51, 66, 70, 482/71; 434/253

(56) References Cited

U.S. PATENT DOCUMENTS

| | | | | |
|---|---|---|---|---|
| 3,708,163 | * | 1/1973 | Hynes | 482/71 |
| 4,846,463 | * | 7/1989 | Klennibbelink | 482/71 |
| 4,869,496 | * | 9/1989 | Colombo | 482/71 |
| 4,909,504 | * | 3/1990 | Yang | 482/51 X |
| 5,064,190 | * | 11/1991 | Holt | 482/70 |
| 5,232,423 | * | 8/1993 | Hajjduczek | 482/68 |
| 5,536,225 | * | 7/1996 | Neuberg et al. | 482/71 |
| 5,582,567 | * | 12/1996 | Chang | 482/71 X |
| 5,665,033 | * | 9/1997 | Palmer | 482/71 |
| 5,692,995 | * | 12/1997 | Alvarez et al. | 482/71 |

* cited by examiner

*Primary Examiner*—Mickey Yu
*Assistant Examiner*—Denise Pothier
(74) *Attorney, Agent, or Firm*—Mallinckrodt & Mallinckrodt; Brian R. Rayve

(57) ABSTRACT

An exercise machine which simulates snow skiing so as to especially develop the muscles of a person particular to snow skiing. A tubular support frame pivotally supports a pair of elongate foot support arms the front end of which are pivotally connected to the frame for multiple axes rotation. The rear end of the foot support arms each have a foot pedal which support the user in an elevated position. A pair of generally vertical pivot arms are pivotally connected at an upper end of each to the support frame with the lower end of each connected to a respective foot support arm. The pivot arms are interconnected by a tie bar for coordinated movement thereof. The movement of the foot support arms is simultaneously about multiple axes comprising lateral horizontal and upward vertical components wherein the foot support arms trace a conical path and the foot pedals trace generally upwardly directed arcuate paths with the foot support arms tilting inwardly to simulate edging of skis. Handle bars on a post which is pivotally attached to the frame and tie bar creates a lateral motion of the handle bars oppositely timed with the foot support arms for upper body balance and conditioning. A pair of damping cylinders or elastic bands add variable resistance during a workout.

6 Claims, 11 Drawing Sheets

SKI SIMULATING EXERCISE MACHINE

BACKGROUND OF THE INVENTION

1. Field

Figure 1:
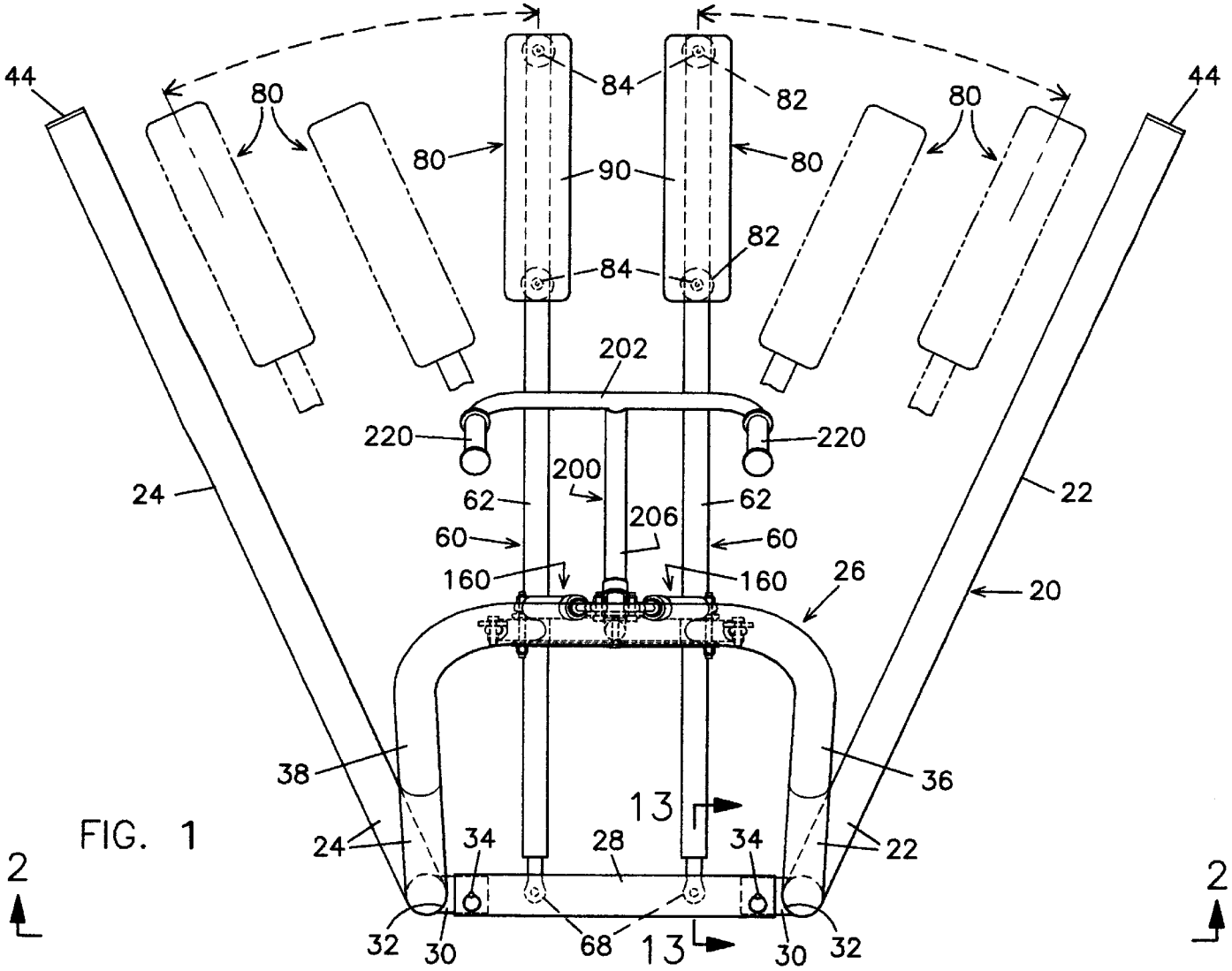

The invention is in the field of exercise machines of the type which develop a person's muscles used during snow skiing by simulating the movements made while snow skiing.

2. State of the Art

The typical exercise gym contains a multitude of different exercise machines of various designs to develop and build various muscles or groups of muscles in a person using such exercise equipment. Generally such exercise equipment is generic in that it is not designed to develop the specific muscles used in any one sport. As related to a specific sport such as snow skiing a person wishing to enhance the strength of muscles specific to snow skiing must determine which muscles are used in snow skiing and use a combination of exercise machines which work out those particular muscles or groups of muscles. This typically required the use of multiple exercise machines since no single exercise machine works all of the required muscles and muscle groups for a particular sport requiring additional time while doing nothing to enhance a person's skills such as balance and timing for the desired sport. Very recently, with the explosion of interest in skiing and snow boarding, several ski simulating exercise machines have been patented.

U.S. Pat. No. 5,692,995 issued to Alvarez et al. discloses a ski simulating exercise machine which has a pair of elongate foot support arms each of which pivot through a limited range of rotational motion about separate axes of rotation. Each respective axis of rotation extends along the intersection of perpendicular planes, one plane for each axis of rotation being substantially perpendicular to a machine central plane and the other planes for each axis of rotation intersecting one another. A gear is affixed to each foot support arm which gears rotate with the respective arm about its axis of rotation. An idler gear links the two gears to coordinate the motion of the respective arms.

U.S. Pat. No. 5,665,033 issued to Palmer discloses a ski simulating exercise machine which has a pair of elongate foot support arms each of which pivot similarly to those in the Alvarez et al. patent. Coordination therebetween, however, is accomplished by means of a pair of hydraulic cylinders one of which connects to each foot support arm and which move hydraulic fluid back and forth therebetween. A separate similar system is used to coordinate a pair of simulated ski poles on the exercise machine.

U.S. Pat. No. 3,659,842 issued to Aijala discloses a ski training machine which has a pair of horizontally rotatable arms pivotably attached to a support base. Each arm has a foot accepting portion in which a person's feet are placed. Each arm has an adjustable braking device to provide variable resistance to pivoting depending to vary the workout based on the user's level of fitness and skill.

U.S. Pat. No. 4,846,463 issued to Kleinnibbelink discloses a ski training machine having a generally horizontal platform upon which a person stands which platform is supported by an elongate arm bent downward at the far end therefrom and which bent portion fits within a bearing structure attached to a support frame. An elongate U-shaped handle bar extends vertically from the support frame for a person to grip during use for balance and for moving the arm from side-to-side. The arm travels in a semicircular upwardly facing arc in use and is self-centering by gravity due to the center position being the lowest position.

SUMMARY OF THE INVENTION

According to the invention is an exercise machine which simulates the particular movements of a person peculiar to snow skiing so as to develop and strengthen those muscles. The exercise machine simulates the motion of snow skiing through a pair of foot support arms which act as simulated snow skis and upon the end of each is mounted a foot pedal which supports the person. The foot support arms pivot about the pivot end opposite the foot pedals about multiple axes longitudinally rotate to more precisely simulate snow skiing. Likewise multiple axes pivots are used elsewhere in the exercise machine produce this unique motion of the foot support arms. The foot support arms are mechanically coordinated to move generally parallel to one another as they are pivoted as in parallel snow skiing. As the support arms are pivoted horizontally from the centered position each support arm moves vertically upward and tilts inwardly toward the center with the innermost foot pedal vertically rising higher than the outermost foot support arm pedal as a skier does when edging in a turn. The foot support arms trace each trace a portion of a generally upwardly directed conical path with the ends thereof tracing generally upwardly directed arcuate paths.

The movement of the foot support arms, which each of which are pivotally attached for multiple axes rotation at the pivot end to the lower portion of a ground contacting support frame is accomplished by means of a pair of generally vertically extending pivot arms, each arm resiliently connected at a lower end thereof to a respective foot support arm by means of angled, or offset brackets intermediate the pivot end and the foot pedal. The upper end of the pivot arms are connected for multiple axes rotation to an upper portion of the support frame. A generally horizontally extending tie bar is pivotally connected at each end thereof to a respective pivot arm intermediate the ends thereof with the tie bar coordinating the movement of the foot support arms.

The exercise machine of the invention can include handle bars having a U-shaped upper gripping portion and an elongate, generally vertical post extending from the middle of the gripping portion which is pivotally connected at the midportion of the stem to an upper portion of the support frame and the lower portion of the stem pivotally connected to the tie bar. The handle bars move laterally in coordinated movement with the foot support arms, the lower portion of the handle bars moving the same direction as the foot support arms and the upper portion of the handle bars including the gripping portion moving opposite thereof. The handle bars gripping portion is gripped in hands to enhance a user's balance and to provide an upper body workout by pushing laterally on the handle bars in coordination with opposite pushing on the foot support arms.

Typically a pair of standard damper cylinders, spring cylinders, heavy elastic bands, or extension springs are advantageously pivotally attached between the ends of the tie bar and the upper frame to increase resistance to lateral movement of the foot support arms so as to provide a more strenuous workout. The placement and the number of cylinders and bands is not critical with multiple positions possible to achieve the same effect.

Preferably the pivot arms can be adjustable in length and/or the relative position of the lower end thereof can be movable along the length of the respective foot support arms so as to allow the relative movement of the foot support arms to change. Lengthening and shortening of the pivot arms can be done by using threaded insert in the ends of the pivot arms which can be rotated to lengthen and shorten the pivot arms.

Similarly, the lower end of each pivot arm can each attached to a bracket which is movable between multiple positions along the length of the respective foot support arms and which can be bolted in the desired position.

The support frame is preferably a generally backwardly bent capital "U" shape with the long legs of the "U" contacting the ground and the short or crossing leg elevated above the ground. A cross brace of the support frame ties the long legs together adding rigidity to the support frame. The foot support arms are pivotally attached to the cross brace for multiple axes rotation. The upper ends of the pivot arms, handle bar vertical post, and cylinders or bands are attached to the short leg of the support frame. While this support frame configuration is economical to manufacture, numerous other frame configurations are possible which achieve similar results.

While the exercise machine of the invention typically comprises pairs of foot support arms and pivot arms, versions thereof having a single foot support arm and pivot arm with the foot support arm having a single double width foot pedal to accommodate two feet are contemplated within the inventive concept. The single foot support arm traces a portion of a generally upwardly directed conical surface and the end thereof traces a generally upwardly directed arcuate path.

THE DRAWINGS

Figure 2:
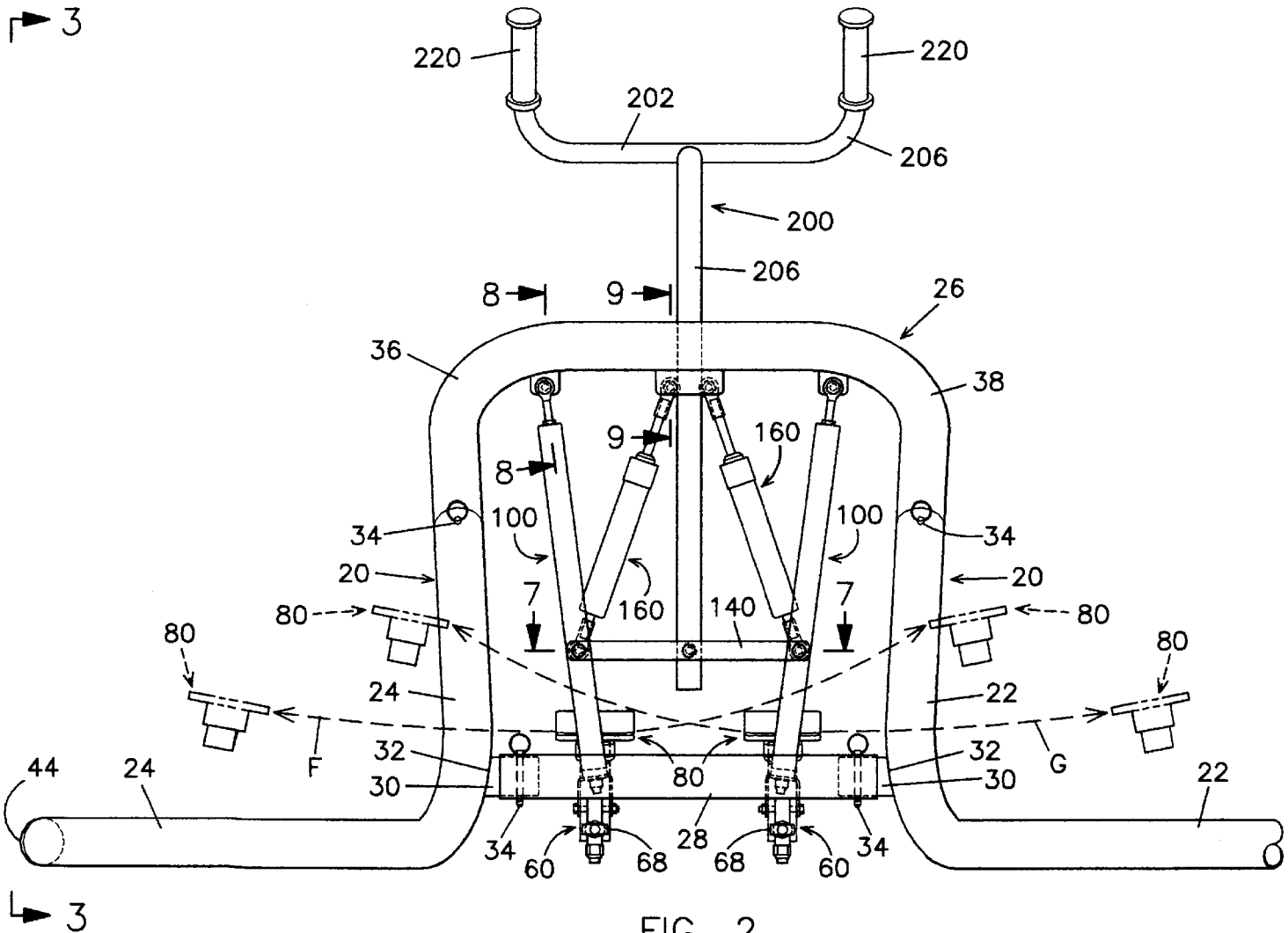
Figure 3:
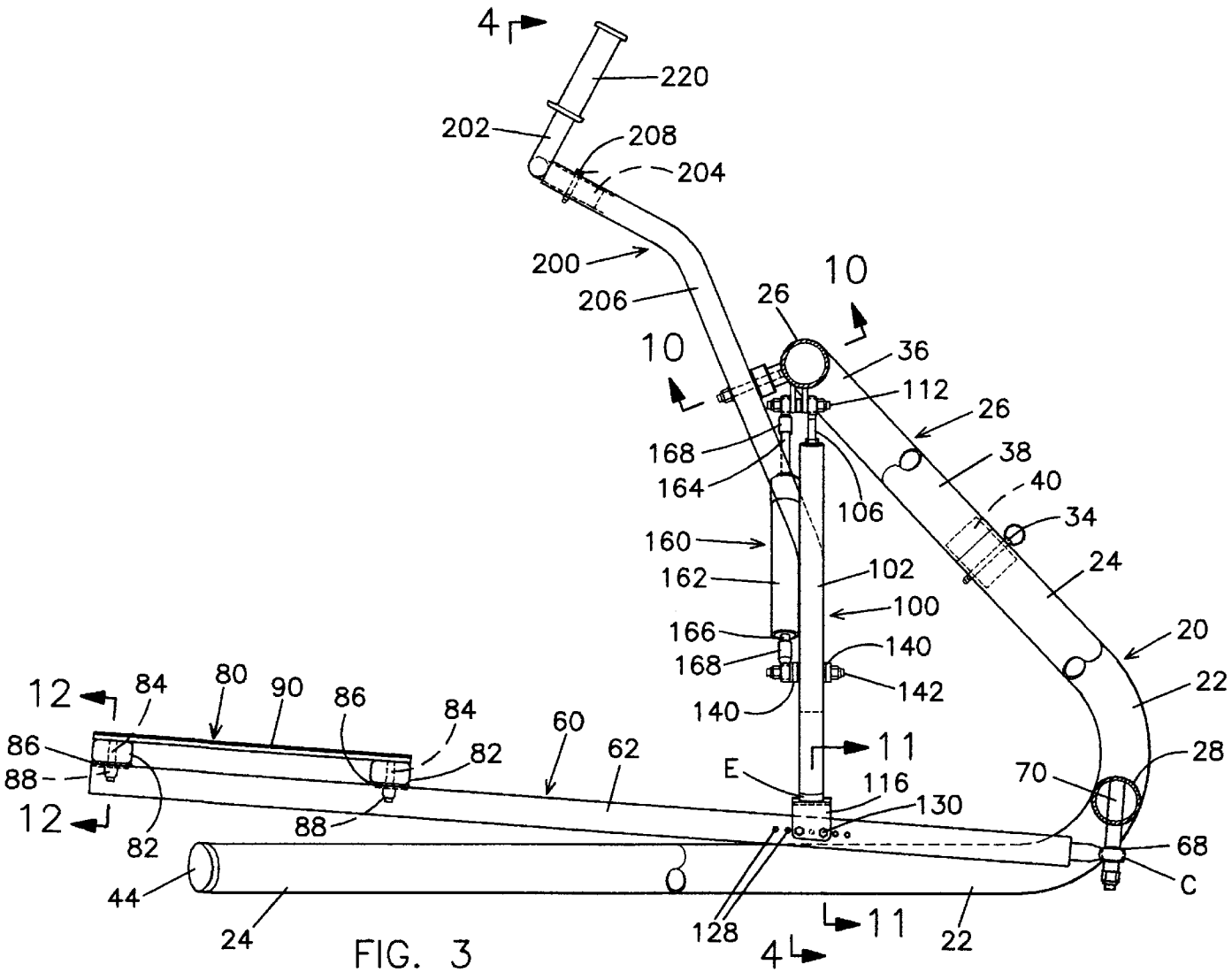
Figure 4:
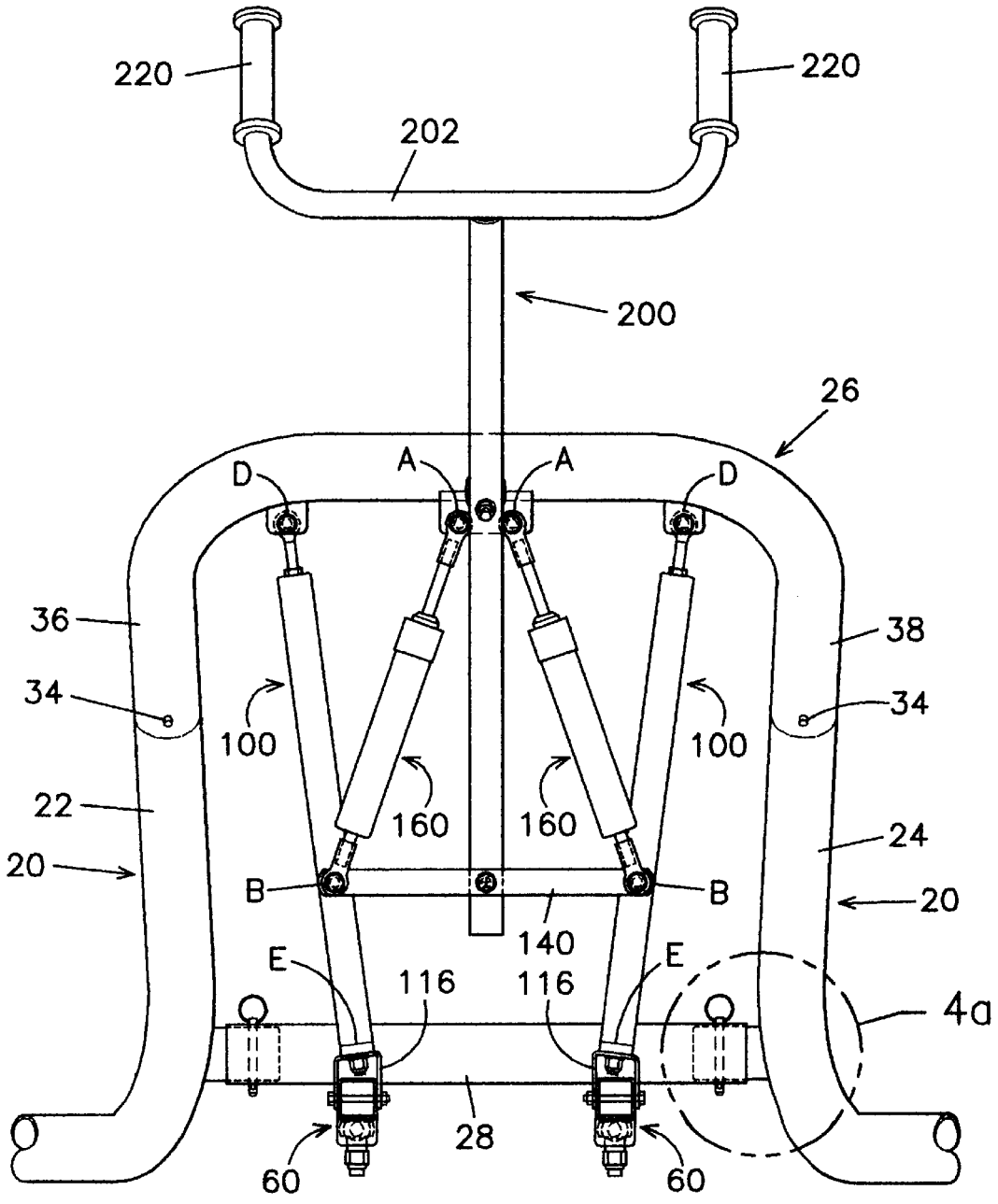
Figure 4B:
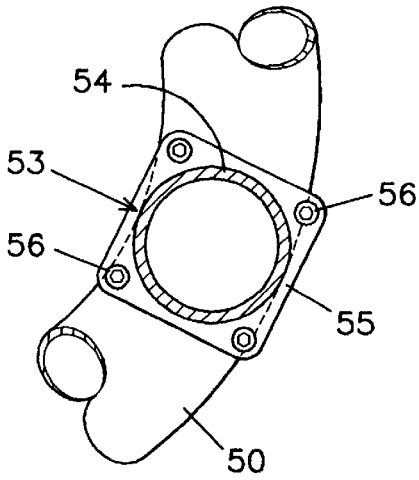
Figure 4A:
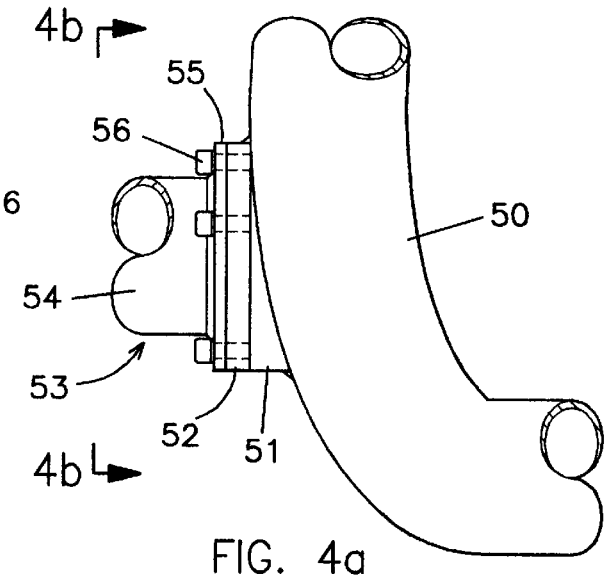
Figure 10A:
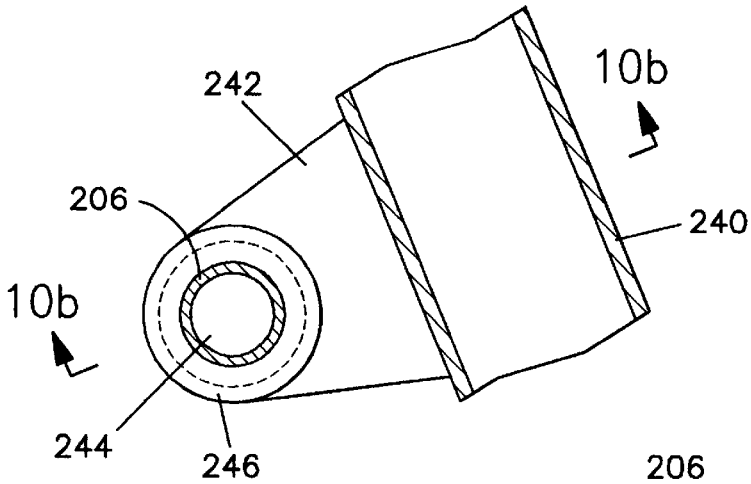
Figure 10B:
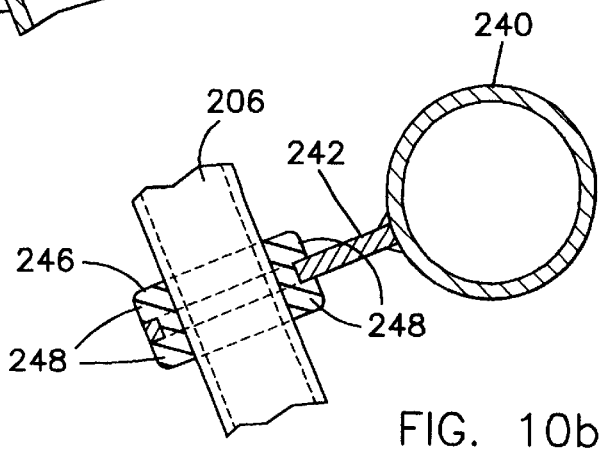
Figure 5:
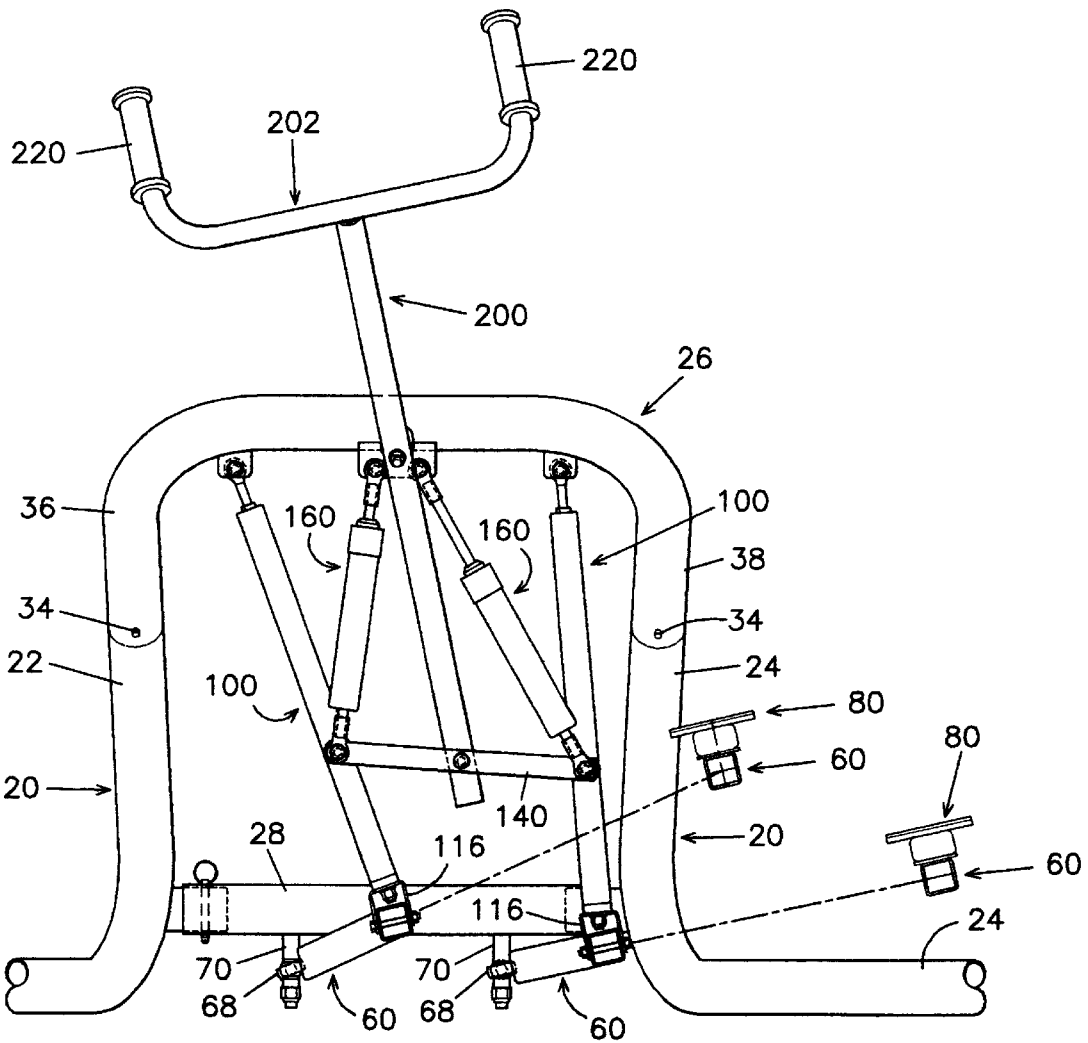
Figure 6:
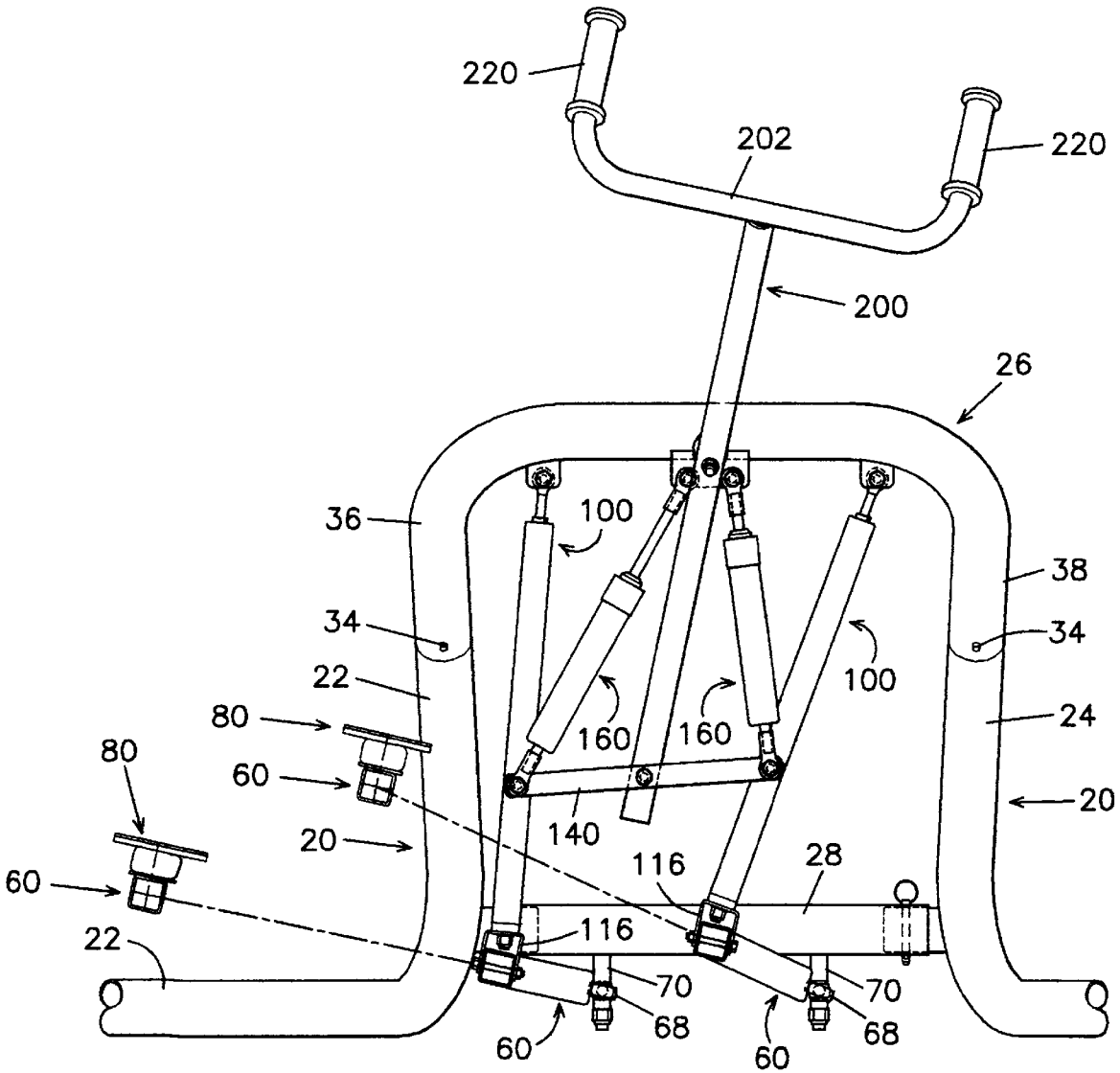
Figure 11:
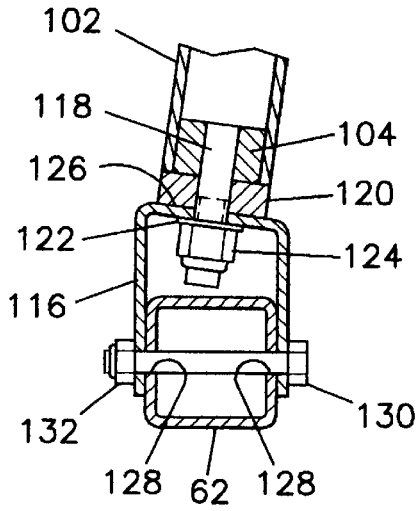
Figure 13:
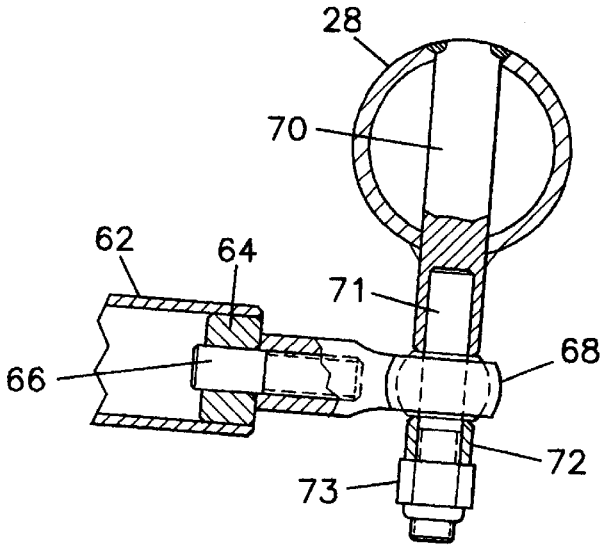
Figure 7:
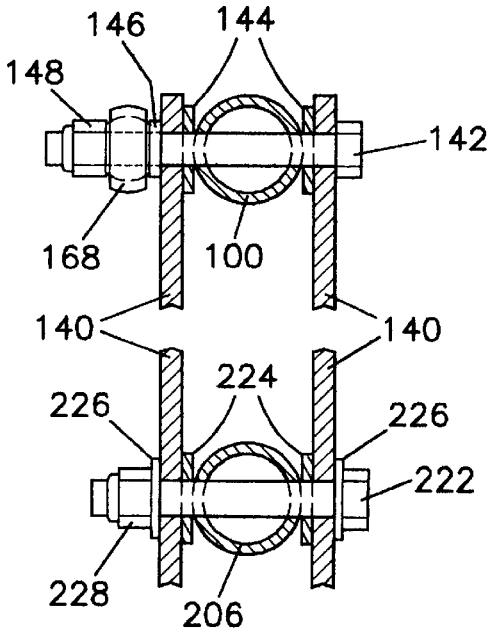
Figure 12:
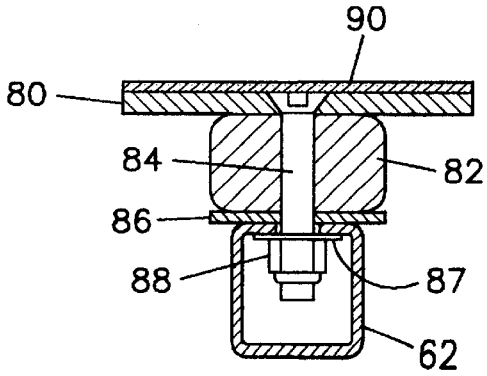
Figure 10:
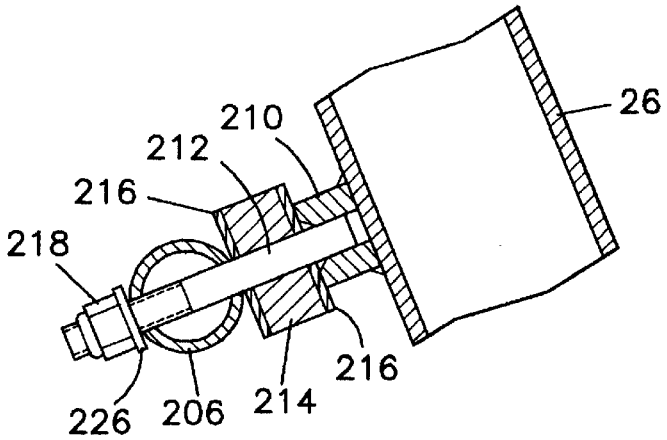
Figure 9:
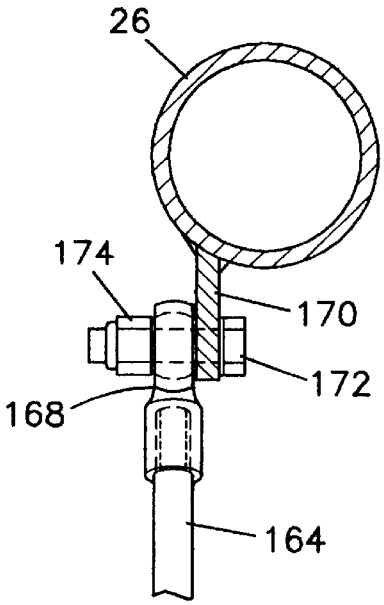
Figure 8:
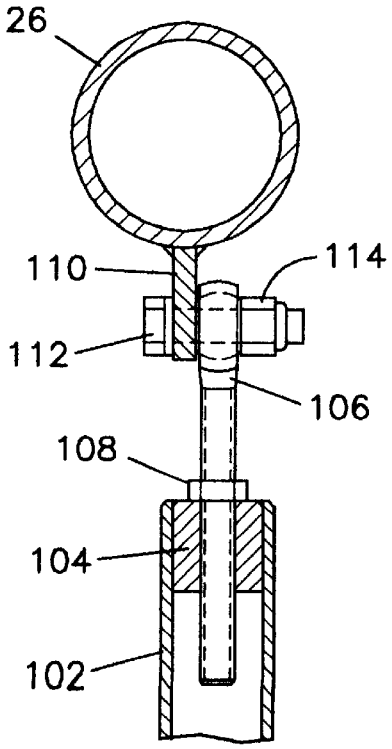
Figure 13A:
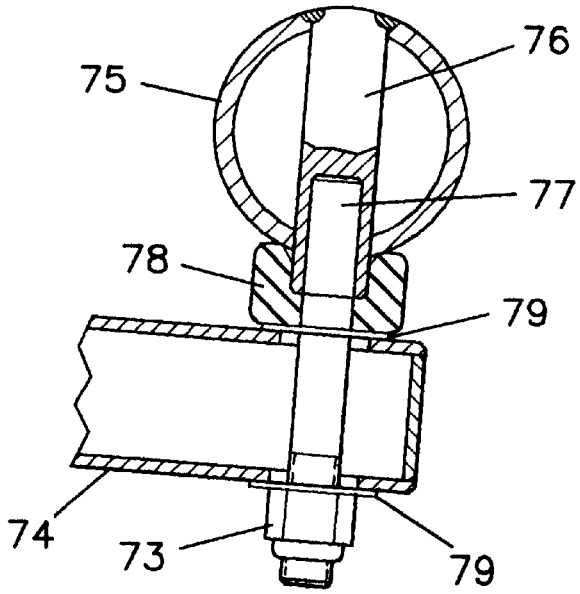
Figure 12A:
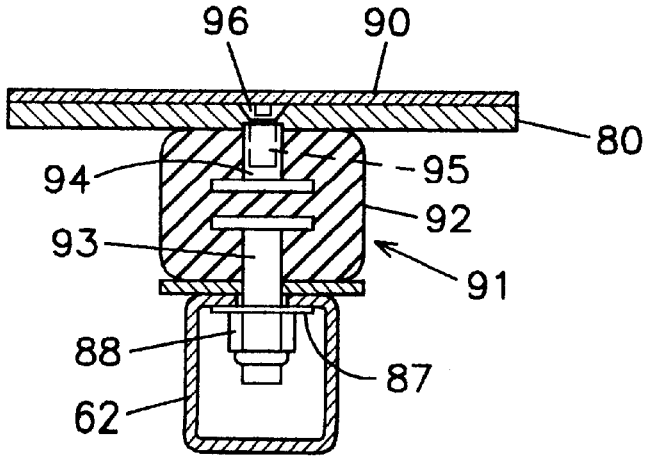
Figure 14:
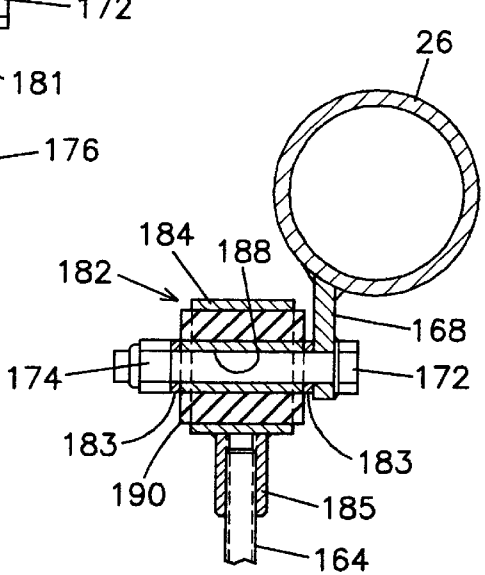
Figure 16:
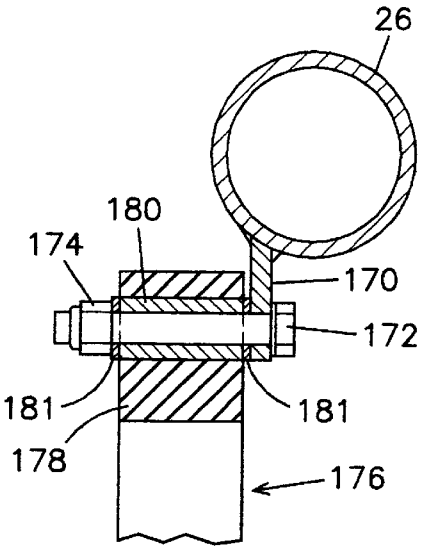
Figure 15:
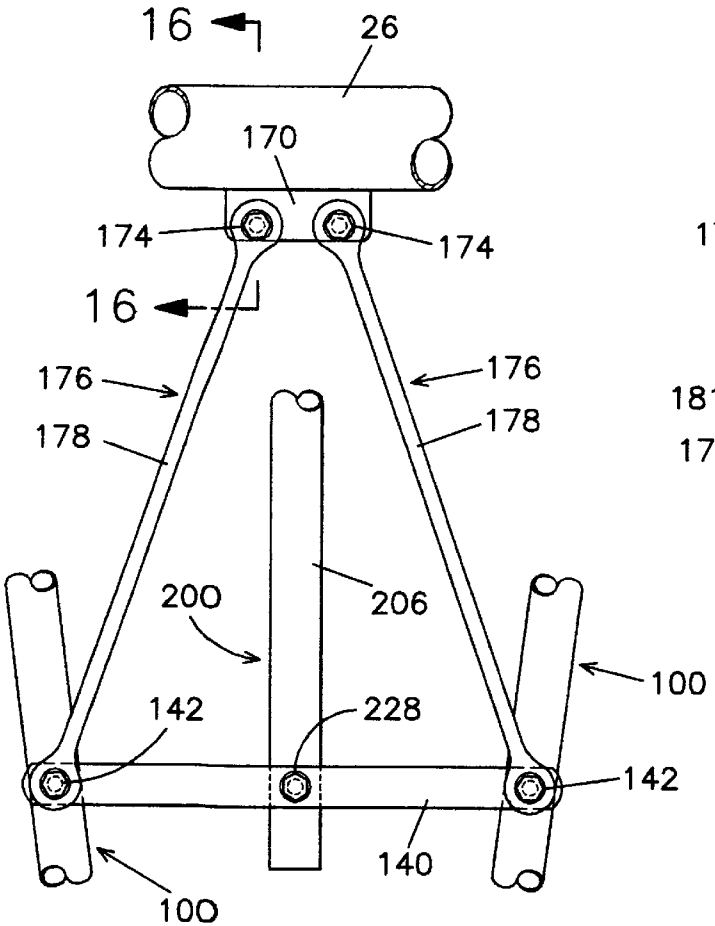

The best mode presently contemplated for carrying out the invention is illustrated in the accompanying drawings, in which:

FIG. 1 is a top plan view of the ski simulating exercise machine of the invention;

FIG. 2, a front elevational view taken on the line 2—2 of FIG. 1;

FIG. 3, a side elevational view taken on the line 3—3 of FIG. 2;

FIG. 4, a fragmentary view in lateral vertical section taken on the line 4—4 of FIG. 3 showing the foot support arms in the center position;

FIG. 4A, a fragmentary view corresponding to FIG. 4 showing an alternate version of the removable cross member;

FIG. 4B, an enlarged fragmentary view in lateral horizontal section showing the details of the connection of the alternate version cross member to the support frame;

FIG. 5, a view corresponding to FIG. 4 showing the foot support arms in the right hand lateral position;

FIG. 6, a view corresponding to FIG. 4 showing the foot support arms in the left hand lateral position;

FIG. 7, a fragmentary view in lateral horizontal section taken on the line 7—7 of FIG. 2 showing the pivotal connections of the handle bar post to the link bars and the pivotal connection of the pivot arms and cylinders to the link bars;

FIG. 8, an enlarged fragmentary view in longitudinal vertical section taken on the line 8—8 of FIG. 2 showing the connection of the pivot arm to the support frame;

FIG. 9, an enlarged fragmentary view in longitudinal vertical section taken on the line 9—9 of FIG. 2 showing the connection of the cylinders to the support frame;

FIG. 10, an enlarged fragmentary view in lateral horizontal section taken on the line 10—10 of FIG. 3 showing the connection of the pivot arms to the support frame;

FIG. 10A, an enlarged fragmentary view corresponding to FIG. 10 showing an alternate version of the connection of the pivot arms to the support frame;

FIG. 10B, an enlarged view in lateral vertical section taken on the line 10B—10B of FIG. 10A showing the connection of the pivot arms to the support frame;

FIG. 11, an enlarged fragmentary view in lateral vertical section taken on the line 11—11 of FIG. 3 showing the connection of the pivot arms to the foot support arms;

FIG. 12, an enlarged fragmentary view in lateral vertical section taken on the line 12—12 of FIG. 3 showing the connection of the foot pedals to the foot support arms;

FIG. 12A, an enlarged fragmentary view corresponding to FIG. 12 showing an alternate version of the connection of the foot pedals to the foot support arms;

FIG. 13, an enlarged fragmentary view in longitudinal horizontal section taken on the line 13—13 of FIG. 1 showing the connection of the foot support arms to the support frame;

FIG. 13A, an enlarged fragmentary view corresponding to FIG. 13 showing an alternate version of the connection of the foot support arms to the support frame;

FIG. 14, an enlarged fragmentary view of an alternate version rod end shown on a threaded cylinder rod which rod end replaces the spherical rod end;

FIG. 15, a fragmentary view of elastic bands used in place of the cylinders on the invention;

FIG. 16, an enlarged fragmentary view longitudinal vertical section taken on the line 16—16 of FIG. 15 showing the metal bushing in the resilient material of the elastic band.

DETAILED DESCRIPTION OF THE ILLUSTRATED EMBODIMENTS

Referring to FIGS. 1, 2, and 3, a ski simulating exercise machine of the invention includes a support frame 20 typically made from steel, aluminum, plastic, or resin coated fabric composite tubing or other similar material and which has the general shape of a backwardly bent capital "U" having a pair of long legs 22 and 24 which contact the ground along the greater portion of their length for lateral and longitudinal support and a short leg 26 which connects long legs 22 and 24 which is elevated from the ground. Long legs 22 and 24 diverge from short leg 26 and provide additional lateral stability for support frame 20. A tubular cross brace 28 of support frame 20 is removably attached to long legs 22 and 24 by means of a pair of opposing tubular plastic plugs 30 which have contoured ends 32 which fit the outer contour of long legs 22 and 24 and which are affixed to long legs 22 and 24 by means such as welding or brazing. Plugs 30 are sized so as to pilot into cross brace 28 and pinned thereto by means of spring-loaded pins 34 extending through cross brace 28 and plugs 30, such spring-loaded pins 34 having a spring biased ball (not shown) extending laterally therefrom to retain the pin in place. Cross brace 28 can be permanently affixed to long legs 22 and 24 by contouring the ends of cross brace 28 and affixing thereto such as by welding or brazing such as when support frame 20 will not need to be shipped disassembled to a user or left disassembled for storage. Likewise, short leg 26 can be made with bent ends 36 and 38 each having a tube insert 40 affixed therein such as by welding or brazing which insert 40 pilots into long legs 22 and 24, respectively, with spring-loaded pins 34 similarly to allow short leg 26 to be disassembled from long legs 22 and 24 for shipment and/or storage purposes. Short leg 26, long leg 22, and long leg 24 can be made as a single elongate bent tube or short leg 26 can be welded to long legs 22 and 24 if disassembly for shipping or storage is not required. A pair of end caps 44 close the ends of long legs 22 and 24 for a more finished appearance.

An alternate version of a removable cross brace is shown in FIGS. 4A and 4B. A support frame 50 has a pair of wedges 51 and flanges 52 affixed thereto such as by welding or brazing at opposite horizontal sides thereof which replace plugs 30. A cross brace 53 has a tube 54 with a pair of flanges 55 affixed at opposite ends thereof such as by welding or brazing. Cross brace bolts to support frame 50 by means of a plurality of bolts 56 which extend through each of flanges 54 and thread into flange 52.

Foot support arms 60 each comprise an elongate rectangular or square cross-section support tube 62 typically made from any of the materials listed for support frame 20 and having at one end an insert 64 which fits into support tube 62 and which is affixed thereto such as by welding or brazing (FIG. 13). A partially threaded stud 66 pilots into insert 64 and is affixed thereto such as by welding or brazing. A female spherical rod end 68 threads onto stud 66. Foot support arms 60 are pivotally mounted to cross brace by means of a pair of internally threaded studs 70 which are affixed into cross brace 28 such as by welding or brazing thereto. A threaded stud 71 passes through a tubular spacer 72 made of metal, plastic, or other similar material, passes through rod end 68, and threads into stud 70 with a nut 73 to secure rod end 68 but allowing foot support arms 60 to pivot in multiple axes and to twist within a range of motion. The vertical height of foot support arms 60 relative to the ground can be changed to suit the user by using various tubular spacers (not shown) similar to spacer 72 above and/or below spherical rod end 68 as required to suit.

An alternate way of connecting a foot support arm is shown in FIG. 13A wherein a slightly longer support tube 74 is connected to a support frame cross brace 75 having an internally threaded stud 76 affixed thereto such as by welding or brazing. A stud 77 threads into stud 76, a resilient cup 78 made of urethane, rubber, or other similar material fits over stud 77 along with a pair of washers 79, and support tube 74, all of which are retained in place by locknut 73. This alternate version pivots about multiple axes and longitudinally along support tube 74 the same as the first version thereof.

At the opposite end of each support tube 62 is a foot pedal 80 which is typically made from any of the materials listed for support frame 20 and which is secured to the respective support tubes 62 with a thick resilient washer 82 therebetween made of urethane, rubber, or other resilient material therebetween by means of countersunk bolts 84, washers 86 and 87, and nuts 88 (FIG. 12). Resilient washers 82 allow foot pedal 80 to laterally pivot relative to support tube 62 for added user comfort and to more realistically simulate the edging involved in snow skiing. A resilient tread material 90 may be secured to the top of foot pedals 80 by means such as adhesives, rivets, or screws so as to minimize slippage of a user's feet thereon.

An alternate version for attaching foot pedal 80 to support tube 62 is shown in FIG. 12A wherein an isolator 91 similar in construction to an automotive engine mount is disposed between foot pedal 80 and support tube 62. Isolator 91 has a resilient body 92 made of urethane, rubber, or similar resilient material. Extending from the lower portion of body 92 is a lower locking stud 93 which is attached to support arm 62 with washers 86 and 87 by means of locknut 88. An upper locking stud 94 having an internally threaded aperture 95 extends from the upper portion of body 92 and is attached to foot pedal 80 by means of a countersunk screw 96. Tread 90 is affixed to foot pedal 80 as previously described.

Each of foot support arms 60 is supported intermediate the ends thereof by a tubular pivot arm 100 which is typically made from materials mentioned for support frame 20 and which has a tube 102 in which a pair of internally threaded inserts 104 affixed in the opposite ends thereof such as by welding or brazing. At the upper end thereof a male spherical rod end 106 is threaded into insert 104 which can be threaded further in or out of insert 104 to adjust the length of pivot arm 100, with a nut 108 securing rod end 106 at the desired position (FIG. 8). A pair of tabs 110 are affixed to support frame short leg 26 and rod ends 106 are connected thereto by means of bolts 112 and locknut 114 such that pivot arms 100 are able to pivot in multiple axes and twist along the longitudinal axis. At the lower end thereof, pivot arm 100 is secured to an offset bracket 116 by means of a threaded stud 118 which threads into insert 104 with a washer 120 typically made of nylon or other similar material to reduce friction, a flat washer 122, and a locknut 124 with washer 120 allowing pivot arm 100 to angularly move slightly relative to offset bracket 116 (FIG. 11). Offset bracket 116 has an angled top 126 which is at such an angle that support tubes 62 are square to the ground when in the centered position. Offset brackets 116 can bolt in a multiple positions by means of a plurality of apertures 128 through support tubes 62 along the length thereof using bolts 130 and locknuts 132 (FIG. 3).

A pair of elongate flat tie bars 140 connect together pivot arms 100 such that they move together such that the movement of foot support arms 60 connected together therewith is coordinated (FIG. 7). Each end of tie bars 140 is pivotally connected to one of pivot arms 100 by means of a bolt 142, a pair of washers 144 typically made of nylon or other material to reduce friction, a spacer 146, and a locknut 148.

A pair of spring or oil damper type cylinders 160 each have a body 162, an extendible partially threaded rod 164 extending from an upper end thereof, and a threaded stud 166 extending from a lower end thereof. A female spherical rod end 168 is threaded onto each of rods 164 and stud 166 such that each of cylinders 160 can be connected thereby at the upper end thereof to a tab 170 affixed to support frame short leg 26 such as by welding or brazing with spherical rod end 168 secured thereto by means of a bolt 172 and a locknut 174 (FIG. 9). On the lower end of cylinders 160 spherical rod ends 168 are connected to bolts 142 between spacers 146 and nuts 148 (FIG. 7).

An alternative to spring or damper 160 is the use of heavy elastic bands 176 comprise an elastic, resilient body 178 made from urethane, rubber, or other elastic material, with a pair of inserts 180 (FIGS. 15 and 16) typically made of metal, plastic, or other similar material. Elastic bands 176 directly replace cylinders 160 bolting in their place using the same hardware except with a pair of flat washers 181 on each side of inserts 180.

Spherical rod ends 168 can be replaced by using flexible joint 182 (FIG. 14) which likewise is pivotable in multiple axes and which comprises an outer tube 184 with attached internally threaded portion 185 each typically made of metal, plastic, or other similar material and which is threaded onto cylinder rod 164. An inner sleeve 188 is concentrically disposed within outer tube 184 with a resilient bushing 190 therebetween typically made of urethane, rubber, or other resilient material to allow outer tube 184 to move relative to inner sleeve 188. Joint 182 is mounted such as to tab 170 just like spherical rod end 168 using bolt 172 but adding a pair of flat washers 183 which retain bushing 190 in place. In this installation, cylinder rod 164 can move in multiple planes an bolt 172 similarly as if spherical rod end 168 were used. A threaded stud (not shown) can be threaded into flexible joint 182 for use in place of spherical rod ends 106 on pivot arms 100 and the same type construction can be used for spherical rod end 68 on foot support arms 60.

A handle bar frame 200 can be added to the exercise machine for upper body development and balance (FIG. 3). Handle bar frame 200 is typically made from any of the materials listed for support frame 20 and comprises a tubular upper U-shaped handle bars 202 having a ninety degree tubular stub post 204 affixed thereto such as by welding or brazing and an elongate tubular mainpost 206 the upper end of which removably connects to stub post 204 by means of a spring-loaded pin 208 which extends through stub post 204 and the upper end of main post 206 (FIG. 3). Mainpost 206 is pivotally connected median the ends thereof to support frame short leg 26 and at the lower end thereof pivotally connected to tie bars 140. The median pivotal connection to support frame short leg 26 is accomplished by means of a metal spacer tube 210 with a partially threaded stud 212 affixed thereto by means such as welding or brazing. Stud 212 extends through a resilient spacer 214 made of urethane, rubber, or other resilient material, a pair of flat washers 216, mainpost 206, and secured by locknut 218. Spacer 214 adds resiliency to the joint to absorb shocks due to a user pushing and pulling on handle bars 202 during use and pivots in multiple axes. A spherical type joint such as in rod ends 168 can also be used here. A pair of handle bar grips 220 made of urethane, rubber, plastic, or other similar material for user comfort and gripping are affixed to handle bars 202 such as by pressfitting or adhesively glued thereto. The lower pivotal connection of mainpost 206 to tie bars 140 is by means of a bolt 222 which extends through each of tie bars 140 and mainpost 206, with washers 224 typically made of nylon or other similar material to reduce friction, and flat washers 226, and secured by locknut 228. A spherical type joint such as in rod ends 168 can be used here as well. As foot support arms 60 move laterally, handle bar frame 200 moves laterally with handle bars 202 moving in the opposite direction therefrom so as to move in a coordinated motion with foot support arms 60.

An alternate version removable connection of the handle bar post 206 to a support frame 240 is shown in FIGS. 10A and 10B wherein a triangular flat bracket 242 is affixed to thereto such as by welding or brazing. Bracket 242 has an aperture 244 there-through in which a resilient grommet 246 made of urethane, rubber, or other similar material is disposed with a pair of resilient lips 248 thereof retaining grommet 246 in place. Handlebar post 206 extends through grommet 246 and is pivotal therein for multiple axes rotation and longitudinal rotation.

The special multiple plane motion of the ski simulating exercise machine foot support arms and foot pedals is achieved by the way foot support arms 60 interact with pivot arms 100 and tie bars 140. Foot support arms 60 are moved laterally by means of the user's feet pushing on foot pedals 80 and/or the user's arms pushing laterally on handle bars frame 200 (FIGS. 5 and 6). The effort required to do so depends on the amount of resistance cylinders 160 apply to respective joints "A" and "B" (FIG. 4). As foot support arms 60 each pivots about the respective pivot "C" and simultaneously about the respective pivot "D" with the respective resilient pivot "E" somewhat resilient (FIG. 3). The movement of the respective pivot arm 100 is restrained by the other thereof such that both foot support arms 60 move generally together to each trace a curved surface with a conical shape the vertex of which is at the respective points "C" (FIG. 3). The end of the foot pedals trace arcuate paths "F" and "G" (FIG. 2). Concurrent with such movement, each of foot support arms 60 rotate inwardly about their respective longitudinal axes (FIGS. 5 and 6). Thus each of foot support arms 80 rotate inwardly when moved laterally outwardly as is done when edging snow skis. The somewhat resilient connection at joint "E" allows some pivoting about the longitudinal axis of the respective foot support arm 60 relative to the respective pivot arm 100 so as to provide a closer simulation of edging of snow skis.

The strenuousness of the workout along with the performance and the "feel" of the exercise machine during use can be adjusted by changing the geometry of the machine and/or by changing the resistance of cylinders 160. The geometry of the machine can be changed by lengthening or shortening pivot arms 100 by screwing rod ends 106 further into or out of the ends thereof (FIG. 8). Shortening pivot arms 100 causes foot pedals 80 at the end of foot support arms 62 to be vertically raised resulting in a tighter conical surface being traced by each of foot support arms 60 and a smaller radius arcuate path to be traced by each of foot pedals 80 resulting in more vertical displacement thereof for a given lateral movement. Lengthening pivot arms 100 results in foot pedals 80 to be vertically lowered resulting in a looser conical surface being traced by each of foot support arms 60 and a larger radius arcuate path to be traced by each of foot pedals 80 resulting in less vertical displacement thereof for a given lateral movement (FIG. 2).

The geometry of the exercise machine can also be changed by moving the mounting of offset brackets 116 toward or away from foot pedals 80 using apertures 128 through support tube 62 (FIG. 3). This can be done separately from or in combination with lengthening or shortening pivot rod 100. The result of moving offset brackets 116 toward foot pedals 80 is analogous to shortening pivot rods 100 and causes foot pedals 80 at the end of foot support arms 62 to be vertically raised resulting in a tighter conical surface being traced by each of foot support arms 60 and a smaller radius arcuate path to be traced by each of foot pedals 80 resulting in more vertical displacement thereof for a given lateral movement. The result of moving offset brackets away from foot pedals 80 is analogous to lengthening pivot rods 100 and causes foot pedals 80 to be vertically lowered resulting in a looser conical surface being traced by each of foot support arms 60 and a larger radius arcuate path to be traced by each of foot pedals 80 resulting in less vertical displacement thereof for a given lateral movement. There may be a slight difference in the radius of the resulting conical surfaces traced by the respective foot support arms 60 and the radius of the curves traced by the respective foot pedals 80 for a given change in foot pedal vertical height due to the fixed positioning of tie bar 140 on pivot arms 100, but the directions of relative movement are comparable.

Unlike prior art exercise machines which have foot support arms which pivot about a single vertical inclined axis in a single plane, foot support arms 60 pivot about no fixed pivot, but rather move in multiple planes and likewise rotate about their longitudinal axis. This produces a banking motion of foot support arms 60 which both of which both move vertically upward as they are moved in either horizontal direction, with the innermost of foot support arms 60 moving vertically the most (FIGS. 2, 3, and 6). At the same time each of foot pedals 60 rotate inwardly about their respective longitudinal axes to provide a total turning and edging feeling to the user like snow skiing. Handle bars frame 200 provide support and balance to the upper body of the user similarly to holding ski poles while snow skiing.

Whereas this invention is here illustrated and described with reference to embodiments thereof presently contemplated as the best mode of carrying out such invention in actual practice, it is to be understood that various changes may be made in adapting the invention to different embodiments without departing from the broader inventive concepts disclosed herein and comprehended by the claims that follow.

I claim:

1. A ski simulating exercise machine, comprising:

a pair of elongate foot support arms;

means for mounting each of said foot support arms comprising a support frame to which a pair of pivot arms are pivotally connected at an upper end thereof to said support frame and at a lower end thereof connected to the foot support arms for multiple axis rotation from a center spaced, generally parallel position to laterally offset positions in either lateral direction wherein such rotation moves a foot support portion of each foot support arm horizontally outwardly and generally upwardly such that an end portion of each foot support arm traces an arcuate generally upwardly sloped path with said foot support arms tilting inwardly;

means for coordinating the movement of said foot support arms so as to maintain a generally parallel position in any pivotal position;

means for applying resistance to movement of the foot support arms comprising a pair of damping cylinders each connected at opposite ends thereof to the support frame and to the respective pivot arm; and wherein the foot support arms are pivotally connected to said support frame for multiple axes rotation.

2. A ski simulating exercise machine, comprising:

a pair of elongate foot support arms;

means for mounting each of said foot support arms comprising a support frame to which a pair of pivot arms are pivotally connected at an upper end thereof to said support frame and at a lower end thereof connected to the foot support arms for multiple axis rotation from a center spaced, generally parallel position to laterally offset positions in either lateral direction wherein such rotation moves a foot support portion of each foot support arm horizontally outwardly and generally upwardly such that an end portion of each foot support arm traces an arcuate generally upwardly sloped path with said foot support arms tilting inwardly;

means for coordinating the movement of said foot support arms so as to maintain a generally parallel position in any pivotal position;

means for applying resistance to movement of the foot support arms comprising a pair of spring cylinders each connected at opposite ends thereof to the support frame and to the respective pivot arm; and wherein the foot support arms are pivotally connected to said support frame for multiple axes rotation.

3. A ski simulating exercise machine, comprising:

a pair of elongate foot support arms;

means for mounting each of said foot support arms comprising a support frame to which a pair of pivot arms are pivotally connected at an upper end thereof to said support frame and at a lower end thereof connected to the foot support arms for multiple axis rotation from a center spaced, generally parallel position to laterally offset positions in either lateral direction wherein such rotation moves a foot support portion of each foot support arm horizontally outwardly and generally upwardly such that an end portion of each foot support arm traces an arcuate generally upwardly sloped path with said foot support arms tilting inwardly;

means for coordinating the movement of said foot support arms so as to maintain a generally parallel position in any pivotal position;

means for applying resistance to movement of the foot support arms comprising a pair of elastic bands each connected at opposite ends thereof to the support frame and to the respective pivot arm; and wherein the foot support arms are pivotally connected to said support frame for multiple axes rotation.

4. A ski simulating exercise machine, comprising:

a pair of elongate foot support arms;

means for mounting each of said foot support arms comprising a support frame to which a pair of pivot arms are pivotally connected at an upper end thereof to said support frame and at a lower end thereof connected to the foot support arms for multiple axis rotation from a center spaced, generally parallel position to laterally offset positions in either lateral direction wherein such rotation moves a foot support portion of each foot support arm horizontally outwardly and generally upwardly such that an end portion of each foot support arm traces an arcuate generally upwardly sloped path with said foot support arms tilting inwardly;

means for coordinating the movement of said foot support arms so as to maintain a generally parallel position in any pivotal position comprising a tie bar pivotally connected at opposite ends thereof to a respective pivot arm intermediate the ends of the respective pivot arm; and wherein the foot support arms are pivotally connected to said support frame for multiple axes rotation.

5. An exercise machine according to claim 4, further comprising handle bar means adapted to move in a coordinated, lateral motion with respect to the foot support arms with an upper handle bar portion thereof moving oppositely from said foot support arms.

6. An exercise machine according to claim 5, wherein the handle bar means comprise an upper U-shaped handle bars with an elongate post extending therefrom which post is pivotally inter-connected with the support frame and the tie bar.

* * * * *